US009133686B2

(12) United States Patent
Ringgenberg

(10) Patent No.: US 9,133,686 B2
(45) **Date of Patent: *Sep. 15, 2015**

(54) DOWNHOLE TESTER VALVE HAVING RAPID CHARGING CAPABILITIES AND METHOD FOR USE THEREOF

(71) Applicant: Halliburton Energy Services, Inc., Houston, TX (US)

(72) Inventor: Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

This patent is subject to a terminal disclaimer.

(21) Appl. No.: 14/061,945

(22) Filed: Oct. 24, 2013

(65) Prior Publication Data

US 2014/0048256 A1 Feb. 20, 2014

Related U.S. Application Data

(63) Continuation of application No. 13/626,618, filed on Sep. 25, 2012, now Pat. No. 8,701,778.

(51) Int. Cl.
*E21B 34/08* (2006.01)
*E21B 49/08* (2006.01)

(52) U.S. Cl.
CPC ..... *E21B 34/08* (2013.01); *E21B 49/087* (2013.01)

(58) Field of Classification Search
CPC ... E21B 34/14; E21B 34/10; E21B 2034/002; E21B 43/12; E21B 34/06; E21B 34/08
See application file for complete search history.

(56) References Cited

U.S. PATENT DOCUMENTS

| | | | |
|---|---|---|---|
| 4,234,043 | A | 11/1980 | Roberts |
| 4,633,952 | A | 1/1987 | Ringgenberg |
| 4,665,983 | A | 5/1987 | Ringgenberg |
| 4,667,743 | A | 5/1987 | Ringgenberg et al. |
| 4,694,903 | A | 9/1987 | Ringgenberg |
| 4,711,305 | A | 12/1987 | Ringgenberg |
| 4,729,430 | A | 3/1988 | White et al. |
| 4,736,798 | A | 4/1988 | Zunkel |
| 4,753,292 | A | 6/1988 | Ringgenberg et al. |
| 4,848,463 | A | 7/1989 | Ringgenberg et al. |
| 4,903,765 | A | 2/1990 | Zunkel |
| 5,058,674 | A | 10/1991 | Schultz et al. |

(Continued)

OTHER PUBLICATIONS

ISR & WO; PCT/US2011/055021; KIPO; May 11, 2012.

*Primary Examiner* — Elizabeth Gitlin

(57) ABSTRACT

A downhole tester valve (100) includes a housing assembly (106) and a mandrel assembly (172, 174) that define therebetween an operating fluid chamber (176), a biasing fluid chamber (184) and a power fluid chamber (180). A valve assembly (126) disposed within the housing assembly (106) is operable between open and closed positions. A piston assembly (146) is operably associated with the valve assembly (126) such that annulus pressure entering the power fluid chamber (180) pressurizes operating fluid in the operating fluid chamber (176) which acts on the piston assembly (146) to shift the valve assembly (126) from the closed position to the open position and such that predetermined travel of the piston assembly (146) opens a bypass passageway (162) for the pressurized operating fluid to charge biasing fluid in the biasing fluid chamber (184), thereby enabling closure of the valve assembly (126) upon reducing annulus pressure by a predetermined amount.

20 Claims, 6 Drawing Sheets

(56) References Cited

U.S. PATENT DOCUMENTS

| | | | |
|---|---|---|---|
| 5,103,906 | A | 4/1992 | Schultz et al. |
| 5,180,007 | A | 1/1993 | Manke et al. |
| 5,180,015 | A | 1/1993 | Ringgenberg et al. |
| 5,649,597 | A | 7/1997 | Ringgenberg |
| 5,791,414 | A | 8/1998 | Skinner et al. |
| 5,813,460 | A | 9/1998 | Ringgenberg et al. |
| 5,819,853 | A | 10/1998 | Patel |
| 5,826,657 | A | 10/1998 | Ringgenberg |
| 5,826,660 | A | 10/1998 | Rytlewski |
| 5,826,662 | A | 10/1998 | Beck et al. |
| 5,890,542 | A | 4/1999 | Ringgenberg |
| 6,065,355 | A | 5/2000 | Schultz |
| 6,182,753 | B1 | 2/2001 | Schultz |
| 6,182,757 | B1 | 2/2001 | Schultz |
| 6,189,392 | B1 | 2/2001 | Schultz |
| 6,192,984 | B1 | 2/2001 | Schultz |
| 6,325,146 | B1 | 12/2001 | Ringgenberg et al. |
| 6,354,374 | B1 | 3/2002 | Edwards et al. |
| 6,446,719 | B2 | 9/2002 | Ringgenberg et al. |
| 6,446,720 | B1 | 9/2002 | Ringgenberg et al. |
| 6,491,104 | B1 | 12/2002 | Wilie et al. |
| 6,527,052 | B2 | 3/2003 | Ringgenberg et al. |
| 6,622,554 | B2 | 9/2003 | Manke et al. |
| 6,729,398 | B2 | 5/2004 | Ringgenberg et al. |
| 7,021,375 | B2 | 4/2006 | Ringgenberg et al. |
| 7,073,579 | B2 | 7/2006 | Ringgenberg et al. |
| 7,086,463 | B2 | 8/2006 | Ringenberg et al. |
| 7,093,674 | B2 | 8/2006 | Paluch et al. |
| 7,096,976 | B2 | 8/2006 | Paluch et al. |
| 7,191,672 | B2 | 3/2007 | Ringgenberg et al. |
| 7,191,844 | B2 | 3/2007 | Kenison et al. |
| 7,389,821 | B2 | 6/2008 | Xu |
| 7,464,755 | B2 | 12/2008 | Edwards |
| 7,926,575 | B2 | 4/2011 | Ringgenberg et al. |
| 2004/0003657 | A1 | 1/2004 | Manke et al. |
| 2006/0196675 | A1 | 9/2006 | Patel et al. |
| 2010/0212910 | A1 | 8/2010 | James |

DOWNHOLE TESTER VALVE HAVING RAPID CHARGING CAPABILITIES AND METHOD FOR USE THEREOF

CROSS-REFERENCE TO RELATED APPLICATIONS

This is a continuation of co-pending application Ser. No. 13/626,618 filed Sep. 25, 2012, which claims the benefit under 35 U.S.C. §119 of the filing date of International Application No. PCT/US2011/055021, filed Oct. 6, 2011.

TECHNICAL FIELD OF THE INVENTION

This invention relates, in general, to equipment utilized in conjunction with operations performed in subterranean wells and, in particular, to downhole tester valves operable for rapid charging of biasing fluid and methods for use thereof.

BACKGROUND OF THE INVENTION

Without limiting the scope of the present invention, its background will be described with reference to downhole testing operations, as an example. Well testing and stimulation operations are commonly conducted on oil and gas wells in order to determine production potential and to enhance the same, if possible. In flow testing a well, a testing string including a tester valve is typically lowered into the well on a string of drill pipe above a packer. After the packer is set, the tester valve is opened and closed periodically to determine formation flow, pressure and rapidity of pressure recovery. Commonly, the operation of such tester valves is responsive to pressure changes in the annulus between the testing string and the wellbore casing. Many such tester valves also provide a biasing source, such as an inert gas like nitrogen, to aid in certain operations of the tester valve, including closure of the tester valve.

In one such arrangement, annulus pressure is used to shift a ball valve assembly in the tester valve from the closed position to the open position. In addition, the annulus pressure is used to charge the biasing source by, for example, compressing nitrogen in a chamber. When the annulus pressure is reduced, the compressed nitrogen is used to shift a ball valve assembly from the open position to the closed position. In this arrangement, a time delay feature, such as a fluid metering section, is used to allow the annulus pressure to first open the ball valve assembly and then charge the nitrogen. For example, it may be desirable to increase the annulus pressure above a certain threshold within one or two minutes in order to open the ball valve assembly, thereafter it may be required that the annulus pressure be maintained at the elevated pressure for another ten or twenty minutes to fully charge the nitrogen.

In certain circumstances, it may be desirable to close the tester valve shortly after opening the tester valve. It has been found, however, that during the period of time delay between opening the ball valve assembly and fully charging the nitrogen, closure of the tester valve is uncertain and in some cases not possible. A need has therefore arisen for an improved tester valve that is operable for flow testing of a well. A need has also arisen for such an improved tester valve that operates responsive to annulus pressure. Further, a need has arisen for such an improved tester valve that does not have a time period during which closure of the tester valve is uncertain or impossible.

SUMMARY OF THE INVENTION

The present invention disclosed herein is directed to a downhole tester valve that is operable to perform flow testing of a well. The downhole tester valve of the present invention is operated between the open position and the closed position responsive to annulus pressure. In addition, the downhole tester valve of the present invention does not have a time period during which closure of the tester valve is uncertain or impossible.

In one aspect, the present invention is directed to a downhole tester valve. The downhole tester valve includes a housing assembly and a mandrel assembly disposed within the housing assembly. The housing assembly and a mandrel assembly define therebetween an operating fluid chamber, a biasing fluid chamber and a power fluid chamber. A valve assembly is disposed within the housing assembly and is operable between open and closed positions. A piston assembly is operably associated with the valve assembly such that annulus pressure entering the power fluid chamber pressurizes operating fluid in the operating fluid chamber which acts on the piston assembly to shift the valve assembly from the closed position to the open position and such that predetermined travel of the piston assembly opens a bypass passageway for the pressurized operating fluid to charge biasing fluid in the biasing fluid chamber, thereby enabling closure of the valve assembly upon reducing annulus pressure by a predetermined amount.

In one embodiment, the operating fluid is oil. In another embodiment, the power fluid is wellbore fluid. In a further embodiment, the biasing fluid is nitrogen. In some embodiments, the piston assembly includes a collet assembly and a snap sleeve having first and second positions relative to the collet assembly. In this embodiment, a first portion of the piston assembly may be shiftable relative to a second portion of the piston assembly such that the collet assembly releases the snap sleeve prior to the piston assembly shifting the valve assembly from the closed position to the open position. In certain embodiments, the piston assembly includes a check valve assembly having opposing check valves. In such embodiments, the check valves may be end of travel opposing check valves such that the travel of the piston within the downhole tester valve actuates one or more of the check valves.

In another aspect, the present invention is directed to a method of operating a downhole tester valve. The method includes positioning the downhole tester valve at a location in a wellbore, the downhole tester valve having an operating fluid chamber, a biasing fluid chamber and a power fluid chamber; applying increased annulus pressure to the power fluid chamber to pressurize operating fluid in the operating fluid chamber; applying the pressurized operating fluid on a piston assembly of the downhole tester valve to shift a valve assembly from a closed position to an open position; and after predetermined travel of the piston assembly, opening a bypass passageway for the pressurized operating fluid to charge biasing fluid in the biasing fluid chamber, thereby enabling closure of the valve assembly upon reducing annulus pressure by a predetermined amount. The method may also include pressurizing oil in the operating fluid chamber, compressing nitrogen in the biasing fluid chamber, shifting a snap sleeve of the piston assembly from a first position to a second position relative to a collet assembly of the piston assembly, actuating at least one check valve in a check valve assembly, actuating at least one check valve responsive to travel of the piston assembly, opening a bypass passageway through the piston assembly, preventing application of the pressurized operating fluid on the piston assembly until annulus pressure is increased above a predetermined level or increasing annulus pressure above a burst pressure of a rupture disk.

In a further aspect, the present invention is directed to a method of operating a downhole tester valve. The method includes positioning the downhole tester valve at a location in a wellbore, the downhole tester valve having an operating fluid chamber, a biasing fluid chamber and a power fluid chamber; applying increased annulus pressure to the power fluid chamber to pressurize operating fluid in the operating fluid chamber; applying the pressurized operating fluid on a piston assembly of the downhole tester valve to shift a valve assembly of the downhole tester valve from a closed position to an open position; charging biasing fluid in the biasing fluid chamber with the pressurized operating fluid; and reducing annulus pressure at a predetermined rate to retain the valve assembly in the open position without the continued application of the increased annulus pressure. The method may also include reducing annulus pressure in stages or substantially equalizing pressure in the biasing fluid chamber and the operating fluid chamber by passing operating fluid through a metering section of the downhole tester valve.

In an additional aspect, the present invention is directed to a method of operating a downhole tester valve. The method includes positioning the downhole tester valve at a location in a wellbore, the downhole tester valve having an operating fluid chamber, a biasing fluid chamber and a power fluid chamber; increasing annulus pressure to a level below a predetermined level; applying the increased annulus pressure to the power fluid chamber to pressurize operating fluid in the operating fluid chamber; applying the pressurized operating fluid on a piston assembly of the downhole tester valve to shift a valve assembly of the downhole tester valve from a closed position to an open position; charging biasing fluid in the biasing fluid chamber with the pressurized operating fluid; and increasing annulus pressure above the predetermined level to disable further operation of the valve assembly. The method may also include increasing annulus pressure above a burst pressure of a rupture disk, reducing annulus pressure and applying operating fluid pressurized by the charged biasing fluid on the piston assembly to shift the valve assembly from the open position to the closed position prior to increasing annulus pressure above the predetermined level, increasing annulus pressure above the predetermined level at a predetermined rate, increasing annulus pressure in stages or substantially equalizing pressure in the biasing fluid chamber and the operating fluid chamber by passing operating fluid through a metering section of the downhole tester valve.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
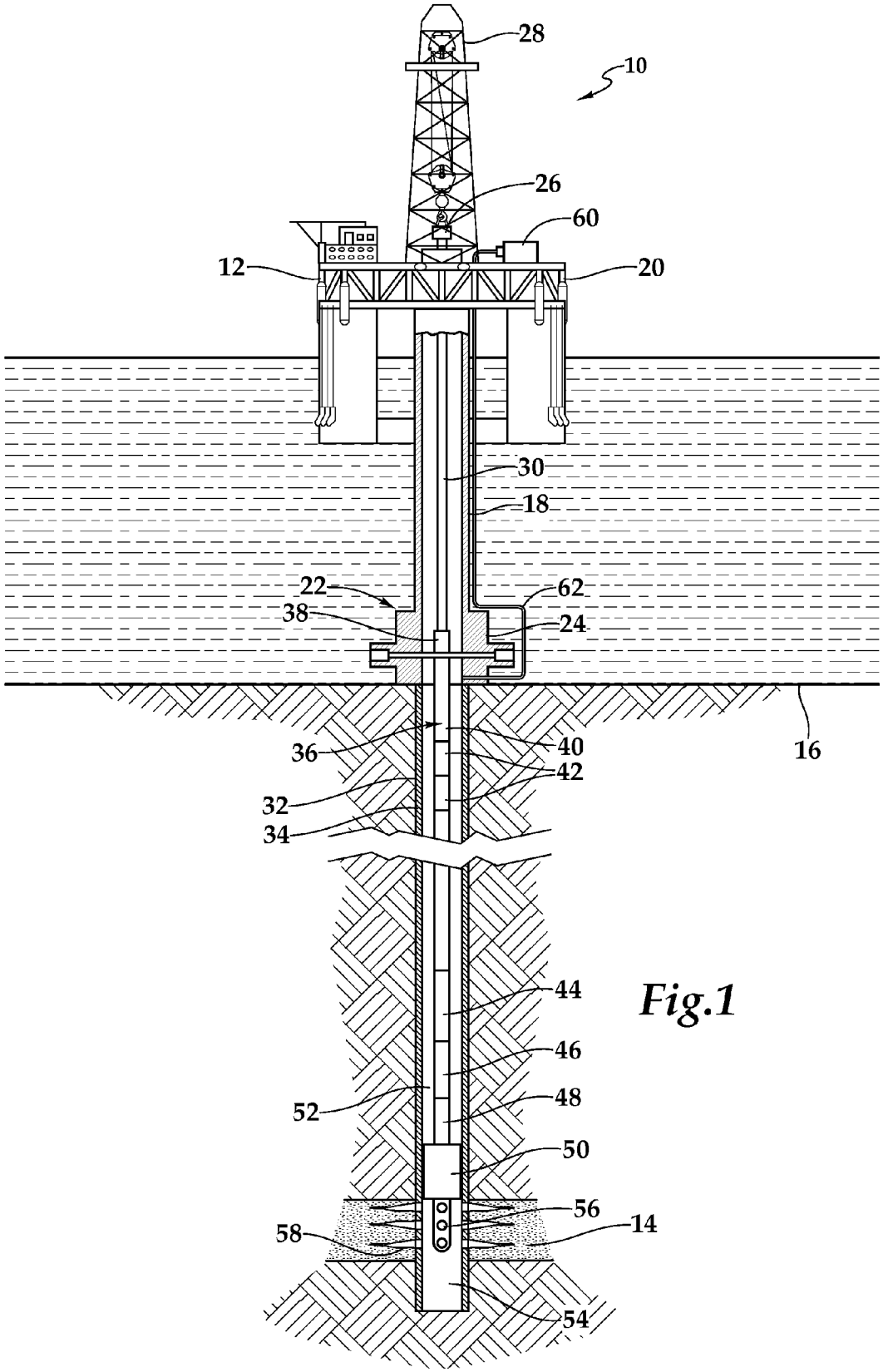
FIG. 1 is a schematic illustration of an offshore oil and gas platform operating a downhole tester valve according to an embodiment of the present invention.

Referring to FIG. 1, a downhole tester valve is being deployed from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as drill string 30. A wellbore 32 has been drilled through the various earth strata including formation 14. Wellbore 32 has a casing string 34 installed therein.

In the illustrated embodiment, a testing string 36 is shown disposed in wellbore 32, with blowout preventer 24 closed thereabout. Testing string 36 includes upper drill pipe string 30 which extends downward from platform 12 to wellhead 22. A hydraulically operated test tree 38 is positioned between upper drill pipe string 30 and intermediate pipe string 40. A slip joint 42 may be included in string 40 for enabling proper positioning of downhole equipment and to compensate for tubing length changes due to pressure and temperature changes. Below slip joint 42, intermediate string 40 extends downwardly to a downhole tester valve 44 of the present invention. Therebelow is a lower pipe string 46 that extends to tubing seal assembly 48, which stabs into packer 50. When set, packer 50 isolates a wellbore annulus 52 from the lower portion of wellbore 54. Packer 50 may be any suitable packer well known to those skilled in the art. Tubing seal assembly 48 permits testing string 36 to communicate with lower wellbore 54 through a perforated tailpipe 56. In this manner, formation fluids from potential producing formation 14 may enter lower wellbore 54 through perforations 58 in casing 34 and be routed into testing string 36.

After packer 50 is set in wellbore 32, a formation test controlling the flow of fluid from potential producing formation 14 through testing string 36 may be conducted using variations in pressure affected in upper annulus 52 by pump 60 and control conduit 62, with associated relief valves (not shown). Formation pressure, temperature and recovery time may be measured during the flow test through the use of instruments incorporated in testing string 36, as downhole tester valve 44 is opened and closed in accordance with the present invention.

Even though FIG. 1 depicts the present invention in a vertical wellbore, it should be understood by those skilled in the art that the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring now to FIGS. 2A-G, therein is depicted an exemplary embodiment of a downhole tester valve 100 in accordance with an embodiment of the present invention. Downhole tester valve 100 includes an upper adaptor 102 having threads 104 at its upper end, whereby downhole tester valve 100 may be secured to drill pipe or other components within the testing string. Downhole tester valve 100 has a housing assembly 106 that is secured to upper adaptor 102 at its upper end. Housing assembly 106 is formed from a plurality of housing members that are threadedly, sealing, weldably or otherwise secured together. Housing assembly 106 includes upper housing member 108, an upper housing connector 110, an upper intermediate housing member 112, an intermediate housing connector 114, a lower intermediate housing member 116, a lower housing connector 118 and a lower housing member 120. At its lower end, lower housing member 120 is secured to a lower adaptor 122 having threads 124 at its lower end, whereby downhole tester valve 100 may be secured to drill pipe or other components within the testing string. Even though a particular arrangement of tubulars has been described and depicted as forming housing assembly 106, it is understood by those skilled in the art that other arrangements of tubular components and the like could alternatively be used to form a housing assembly without departing from the principles of the present invention.

Generally positioned within upper housing member 108 is a valve assembly 126. Valve assembly 126 includes an upper cage support 128, a ball cage 130, an upper annular seat 132 that is downwardly biased by one or more springs 134, a pair of operating pins 136 (only one being visible in FIG. 2B), a rotating ball member 138, a lower annular seat 140 and a lower cage support 142. Together, the components of valve assembly 126 cooperate to open and close the central pathway 144 of downhole tester valve 100 to selectively allow and prevent fluid flow therethrough.

Generally positioned within upper intermediate housing member 112 is a piston assembly 146. Piston assembly 146 includes a valve operating member 148 that is coupled at its upper end (see FIG. 2B) to operating pins 136 of valve assembly 126. Piston assembly 146 also includes a check valve assembly 150, a snap sleeve 152, a split ring 154 and a collet assembly 156 that is securably coupled at its lower end to intermediate housing connector 114. In the illustrated embodiment, check valve assembly 150 is slidably and sealingly positioned between valve operating member 148 and upper intermediate housing member 112. Check valve assembly 150 includes a pair of oppositely disposed check valves 158, 160, having a fluid passageway 162 therebetween that may be referred to as a bypass passageway. Check valves 158, 160 each has a stem that is extendable outwardly from check valve assembly 150, the operation and purpose of the stems are discussed in greater detail below. In the illustrated embodiment, split ring 154 is received in a radially reduced section of valve operating member 148. A gap exists between split ring 154 and the lower surface of check valve assembly 150 and likewise, gap exists between split ring 154 and an upper shoulder of a snap sleeve 152, the operation and purpose of the gaps are discussed in greater detail below. Collet assembly 156 includes a plurality of collet fingers 164, only one being visible in the FIG. 2D. Each collet finger 164 has a detent 166. Snap sleeve 152 includes a pair of annular grooves 168, 170 that are designed to selectively and releasably cooperate with detents 166 of collet fingers 164.

Generally positioned within lower intermediate housing member 116 is an upper mandrel 172. In the illustrated embodiment, upper mandrel 172 is threadedly and sealably coupled to intermediate housing connector 114 at its upper end and sealably coupled to lower housing connector 118 at its lower end. Generally positioned within lower housing member 120 is a lower mandrel 174. In the illustrated embodiment, lower mandrel 174 is sealably coupled to lower housing connector 118 at its upper end and threadedly and sealably coupled to lower adaptor 122 at its lower end. Together, upper mandrel 172 and lower mandrel 174 may be referred to herein as a mandrel assembly. Even though a particular arrangement of tubulars has been described and depicted as forming the mandrel assembly, it is understood by those skilled in the art that other arrangements of tubular components and the like could alternatively be used to form a mandrel assembly without departing from the principles of the present invention.

Together, lower intermediate housing member 116 and upper mandrel 172 define a generally annular operating fluid chamber 176, which extends between a lower surface of intermediate housing connector 114 and an upper surface of a floating piston 178 that is disposed between lower intermediate housing member 116 and upper mandrel 172. Preferably, operating fluid chamber 176 contains an operating fluid in the form of a substantially incompressible fluid such as an oil including hydraulic fluid. Lower intermediate housing member 116 and upper mandrel 172 also define a generally annular power fluid chamber 180, which extends between a lower surface of floating piston 178 and an upper surface of lower housing connector 118. Power fluid chamber 180 is aligned with one or more housing ports 182 that extend through lower intermediate housing member 116 to provide fluid communication with annulus fluid pressure. In the illustrated embodiment, a housing port 182 is depicted in dashed lines as it is not actually located in the illustrated cross section but instead is circumferentially offset from the illustrated view. Together, lower housing member 120 and lower mandrel 174 define a generally annular biasing fluid chamber 184, which extends between a lower surface of floating piston 186 that is disposed between lower housing member 120 and lower mandrel 174 and an upper surface of lower adaptor 122. Preferably, biasing fluid chamber 184 contains a biasing fluid in the form of a compressible fluid such as a gas and more preferably, biasing fluid chamber 184 contains an inert gas such as nitrogen.

Downhole tester valve 100 includes an operating fluid communication network. In the present invention, operating fluid is used not only to actuate the valve assembly between open and closed positions but also for rapid charging of the biasing fluid after shifting the valve assembly from the closed position to the open position. The operating fluid communication network includes a plurality of fluid passageways that are formed in various section of housing assembly 106. In the illustrated embodiment, operating fluid used to downwardly shift piston assembly 146 and open valve assembly 126 has a communication path from operating fluid chamber 176 through fluid passageway 188 in intermediate housing connector 114 and fluid passageway 190 in upper intermediate housing member 112. The operating fluid is then operable to act on an upper surface of check valve assembly 150 of piston assembly 146.

Figure 2A:
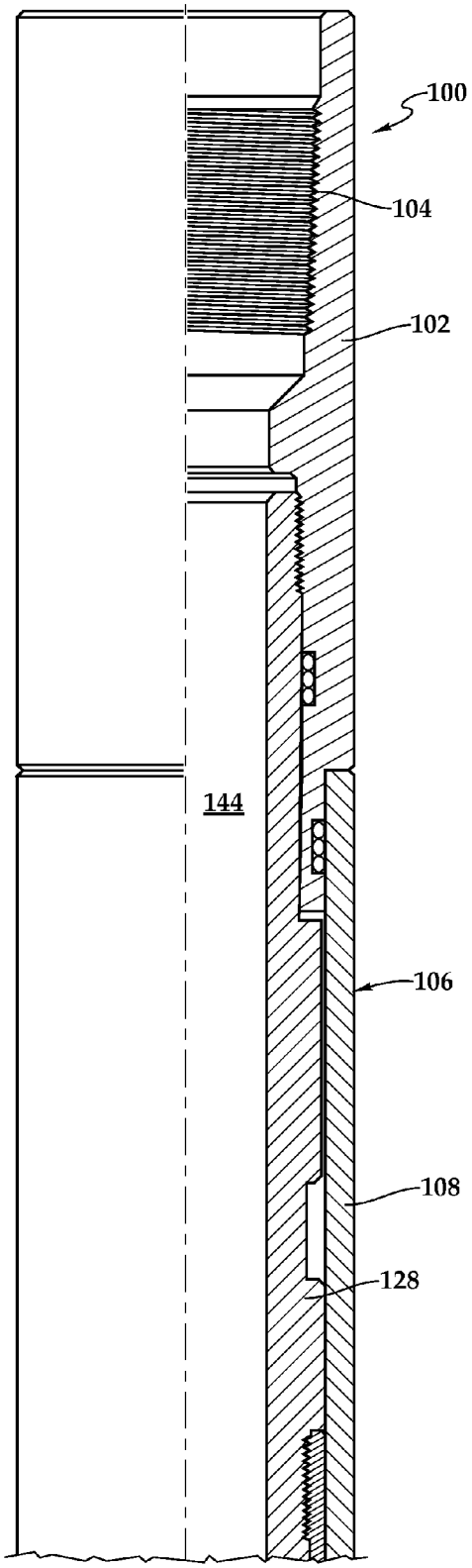
FIGS. 2A-G are quarter sectional views of a downhole tester valve according to an embodiment of the present invention.
Figure 2B:
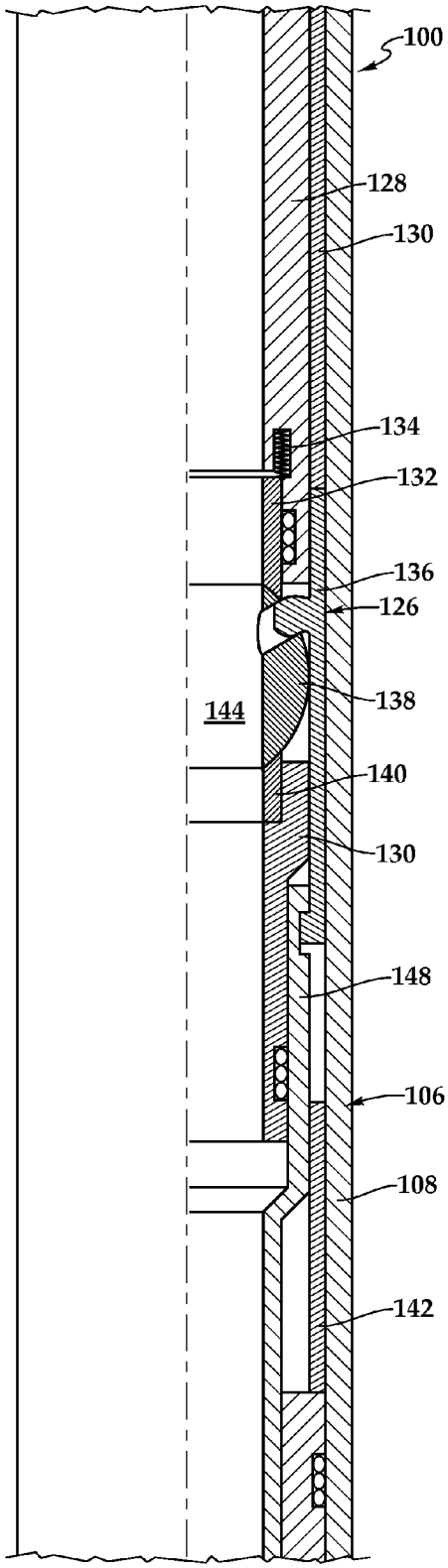
Figure 2C:
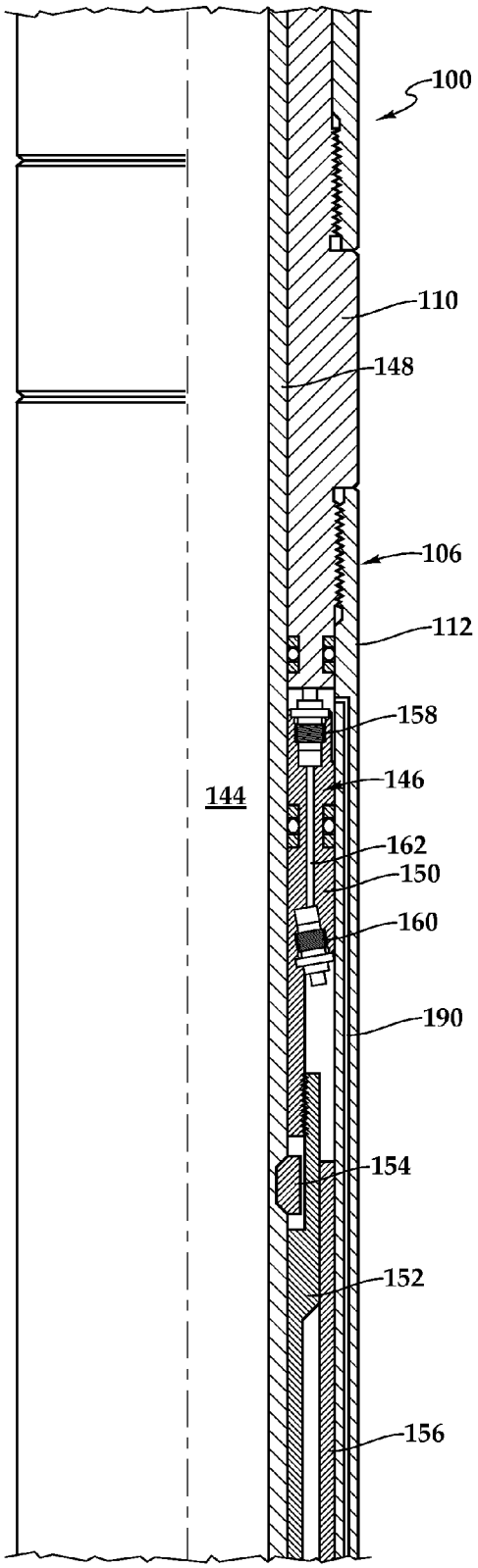
Figure 2D:
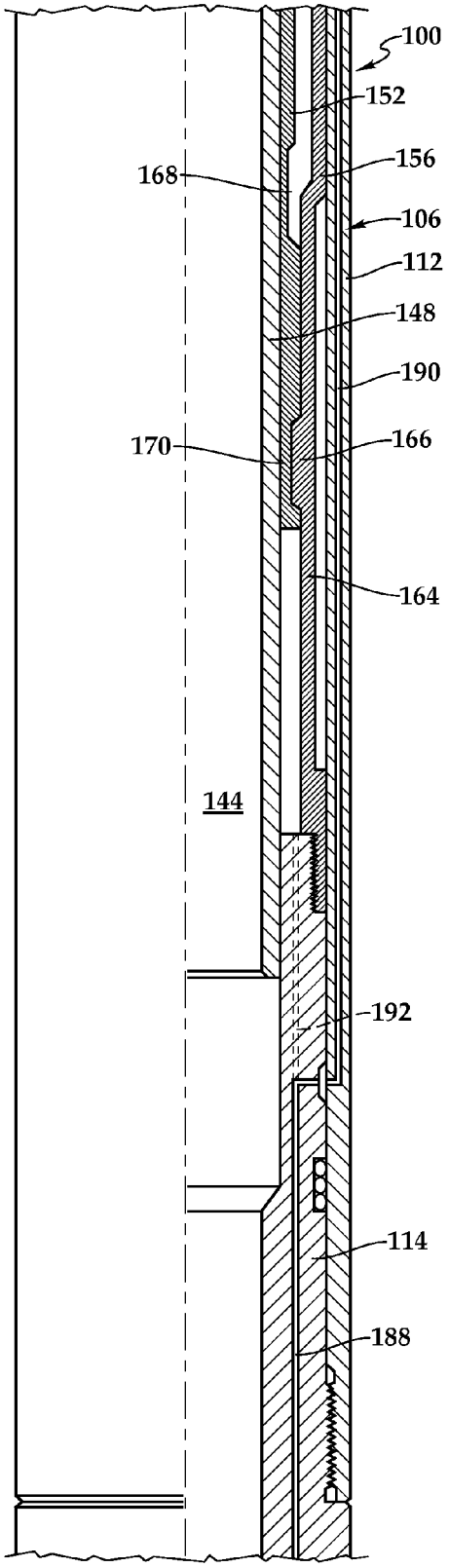
Figure 2E:
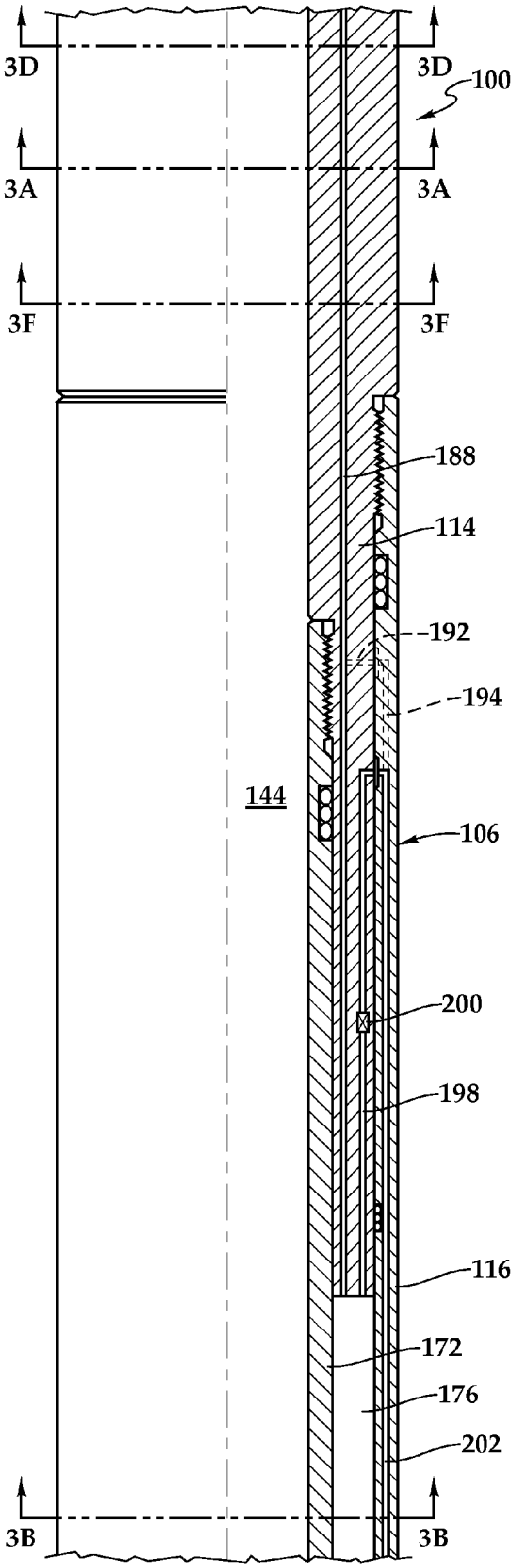
Figure 2F:
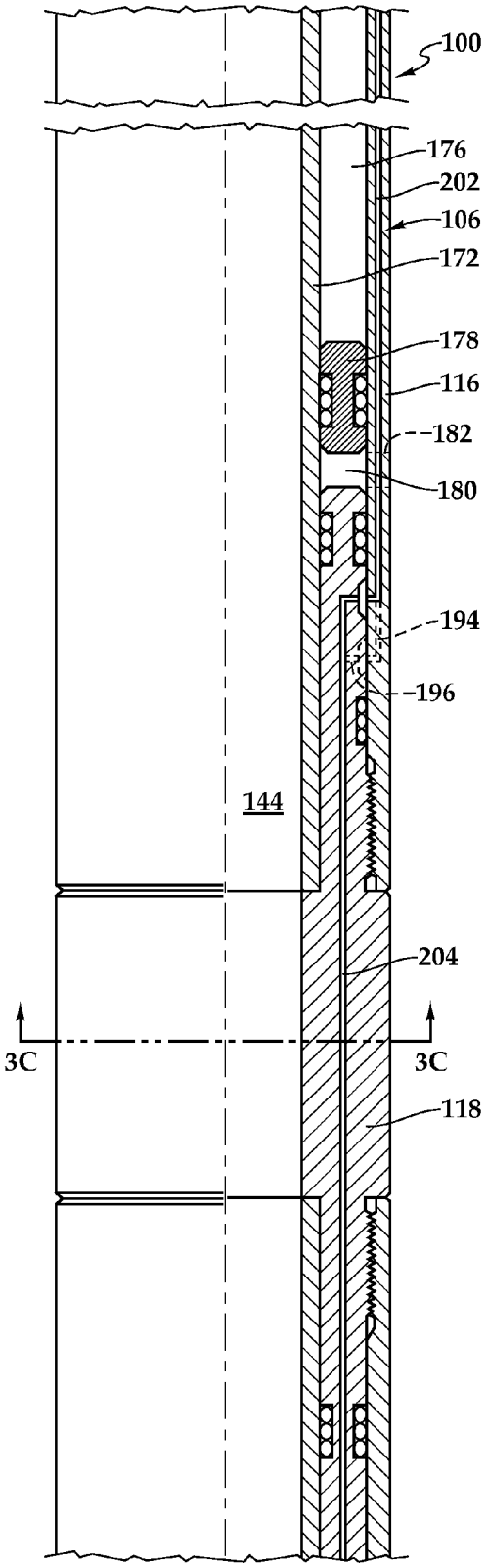
Figure 3A:
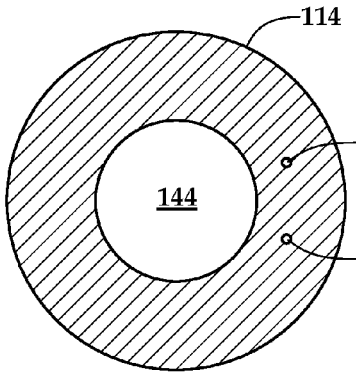
FIGS. 3A-F are cross sectional views at various locations along a downhole tester valve according to an embodiment of the present invention.
Figure 3B:
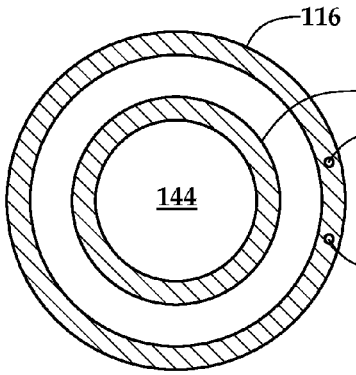
Figure 3C:
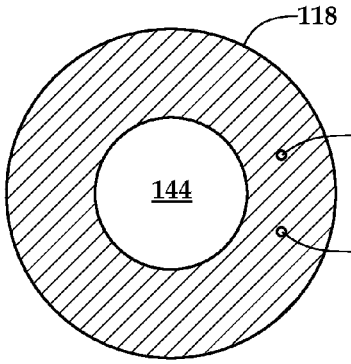

As explained in greater detail below, after the operating fluid has downwardly shifted piston assembly 146 causing valve assembly 126 to open, the operating fluid has a communication path through fluid passageway 162 in check valve assembly 150, through the annular region between upper intermediate housing member 112 and valve operating member 148, through fluid passageway 192 in intermediate housing connector 114 (a portion of which is depicted in dashed lines in FIGS. 2D and 2E, and as best seen in FIG. 3A), through fluid passageway 194 in lower intermediate housing member 116 (a portion of which is depicted in dashed lines in FIGS. 2E and 2F, and as best seen in FIG. 3B) and through fluid passageway 196 in lower housing connector 118 (a portion of which is depicted in dashed lines in FIG. 2F, and as best seen in FIG. 3C). The operating fluid is then operable to act on an upper surface of floating piston 186.

As explained in greater detail below, after the operating fluid has charged the biasing fluid and annulus pressure is reduced, the operating fluid has a communication path through fluid passageway 196 in lower housing connector 118 (a portion of which is depicted in dashed lines in FIG. 2F, and as best seen in FIG. 3C), through fluid passageway 194 in lower intermediate housing member 116 (a portion of which is depicted in dashed lines in FIGS. 2F and 2E, and as best seen in FIG. 3B), through fluid passageway 192 in intermediate housing connector 114 (a portion of which is depicted in dashed lines in FIGS. 2E and 2D, and as best seen in FIG. 3A) and through the annular region between upper intermediate housing member 112 and valve operating member 148. The operating fluid is then operable to act on a lower surface of check valve assembly 150.

Figure 2G:
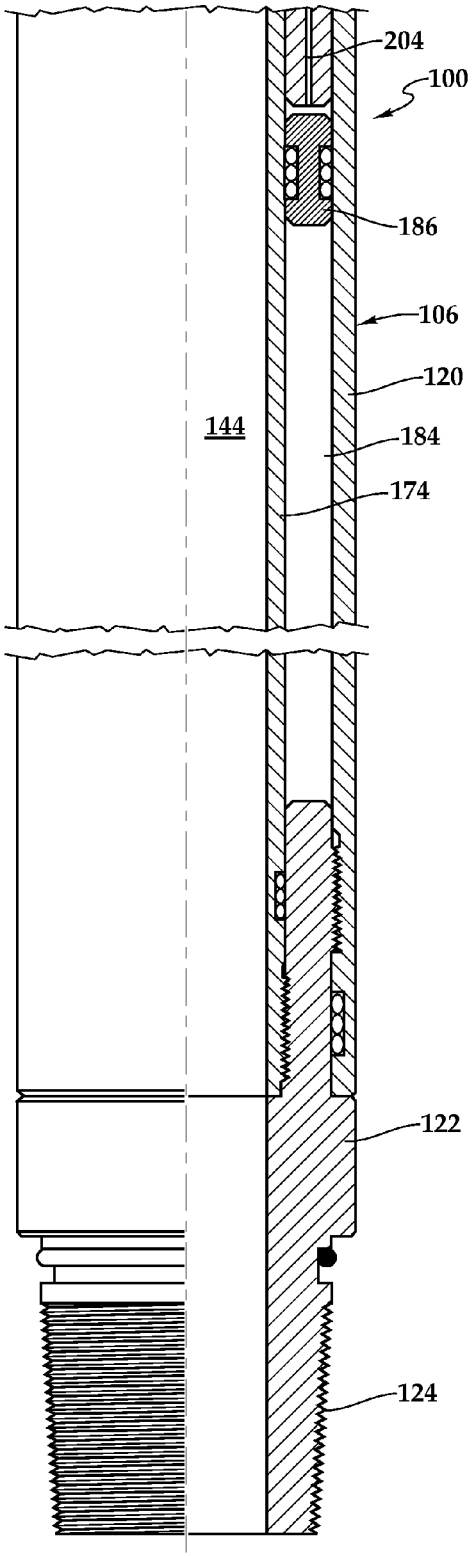

In addition, the operating fluid communication network of downhole tester valve 100 includes a metered fluid pathway between operating fluid chamber 176 and the upper side of floating piston 186, the purpose and operation of which is discussed in greater detail below. In the illustrated embodiment, a fluid pathway 198 in intermediate housing connector 114 includes a metering section 200 having a fluid resistance assembly such as an orifice disposed therein to limit the rate at which operating fluid can pass therethrough. Fluid pathway 198 is in fluid communication with fluid pathway 202 in lower intermediate housing member 116 (as best seen in FIGS. 2E, 2F and 3B) which is in fluid communication with fluid passageway 204 in lower housing connector 118 (as best seen in FIGS. 2F, 2G and 3C). The operating fluid is then operable to act on an upper surface of floating piston 186.

The operation of downhole tester valve 100 will now be described. In one operating mode, downhole tester valve 100 is run downhole on a testing string in the closed position as depicted in FIGS. 2A-2G. A packer positioned downhole of downhole tester valve 100 on the testing string may be set which creates a sealed annulus between the casing string and the testing string above the packer as seen in FIG. 1. Depending upon the tests to be performed, it may be desirable to open and close downhole tester valve 100 numerous times. During run in and prior to operation, the pressure in operating fluid chamber 176 and biasing fluid chamber 184 are generally equalized to wellbore or annulus pressure due to fluid communication through port 182 acting on floating piston 178 and fluid passing through metering section 200 of downhole tester valve 100 acting on floating piston 186.

To open downhole tester valve 100, annulus pressure is increased to a predetermined level. The annulus pressure enters downhole tester valve 100 via port 182 and acts on floating piston 178. Pressure is increased in operation fluid chamber 178 which forces operating fluid into fluid passageways 188 and 198. Fluid travel is resisted through fluid passageway 198 by metering section 200. The fluid in passageway 188 is communicated to fluid passageway 190 which in turn is communicated to an upper surface of check valve assembly 150 of piston assembly 146. In this configuration, check valve 158 allows downward flow therethrough but, downward flow is prevented by check valve 160. The fluid pressure generates a downward force on check valve assembly 150 which is transmitted through piston assembly 146 to annular groove 170 of snap sleeve 152 and detents 166 of collet fingers 164. When the downward force of annular groove 170 is sufficient to cause radial outward expansion of collet fingers 164, snap sleeve 152 begins to translate downwardly relative to collet assembly 156. The lower surface of check valve assembly 150 then closes the gap and moves into contact with the upper surface of split ring 154 which causes valve operating member 148 to begin downward travel. It is noted that having the gap between the lower surface of check valve assembly 150 and the upper surface of split ring 154 ensures that the force required to overcome the spring force of collet assembly 156 and the force required to rotate ball member 138 are not additive of one another, instead, the spring force of collet assembly 156 is overcome prior to operation of ball member 138. The fluid pressure acting on check valve assembly 150 now moves all the components of piston assembly 146, with the exception of collet assembly 156, downwardly. The downward movement of valve operating member 148 also caused downward movement of operating pins 136 which rotates ball member 138 to the open position.

When ball member 138 is fully open, a lower surface of operating pins 136 may contact an upper surface of lower cage support 142. In addition, a stem mechanism of check valve 160 comes in contact with an upper surface of collet assembly 156 which opens check valve 160 as piston assembly 146 nears its end of travel. When check valve 160 opens, a bypass passageway is established allowing operating fluid to pass from fluid passageway 162 into the annular region between upper intermediate housing member 112 and valve operating member 148 and communicate fluid pressure through fluid passageway 192, fluid passageway 194 and fluid passageway 196. The operating fluid is then operable to act on an upper surface of floating piston 186 which compresses or charges the biasing fluid in biasing fluid chamber 184. As such, the present invention enables rapid charging of the biasing fluid as soon as the valve assembly is operated from the closed position to the open position. This rapid charging enables immediate closure of the valve assembly using the rapidly charged biasing fluid.

For example, when it is desired to return downhole tester valve 100 to the closed position, annulus pressure is decreased to a predetermined level which reduces the pressure in operating fluid chamber 176, fluid passageway 188, fluid passageway 190 and on the top side of check valve assembly 150. Fluid does not travel upwardly through check valve assembly 150, however, as check valve 158 prevents such upward flow. The charged biasing fluid in biasing fluid chamber 184 now acts as the energy source for operating valve assembly 126. The biasing fluid acts on the lower surface of floating piston 186 which pressurizes the operating fluid above floating piston 186 in fluid passageway 196, fluid passageway 194, fluid passageway 192 and the annular region between upper intermediate housing member 112. The pressurized operating fluid acts on the lower surfaces of check valve assembly 150 of piston assembly 146. The fluid pressure generates an upward force on check valve assembly 150 which is transmitted through piston assembly 146 to annular groove 168 of snap sleeve 152 and detents 166 of collet fingers 164. When the upward force of annular groove 168 is sufficient to cause radial outward expansion of collet fingers 164, snap sleeve 152 begins to translate upwardly relative to collet assembly 156. An upper surface of snap sleeve 152 then closes the gap and moves into contact with the lower surface of split ring 154 which causes valve operating member 148 to begin upward travel. The gap between the upper surface of snap sleeve 152 and the lower surface of split ring 154 ensures that the force required to overcome the spring force of collet assembly 156 and the force required to rotate ball member 138 are not additive of one another, instead, the spring force of collet assembly 156 is overcome prior to operation of ball member 138. The fluid pressure acting on check valve assembly 150 now moves all the components of piston assembly 146, with the exception of collet assembly 156, upwardly. The upward movement of valve operating member 148 also caused upward movement of operating pins 136 which rotates ball member 138 to the closed position.

When ball member 138 is fully closed, an upper surface of operating pins 136 may contact a lower surface of ball cage 130. In addition, a stem mechanism of check valve 158 comes in contact with a lower surface of upper housing connector 110 which opens check valve 158 as piston assembly 146 nears its end of travel. When check valve 158 opens, operating fluid is allowed to pass from fluid passageway 162 into fluid passageway 190 and fluid passageway 188 to return to operating fluid chamber 176, which substantially equalizes pressure in power fluid chamber 180, operating fluid chamber 176 and biasing fluid chamber 184. This returns downhole tester valve 100 to its running configuration, in which it is ready to be operated to its open position with an increase in annulus pressure.

In another operating mode, it may be desirable to maintain downhole tester valve 100 in the open position without keeping annulus pressure at the elevated level. In this case, once valve assembly 126 has been shifted from the closed position to the open position and the operating fluid has rapidly charged the biasing fluid as described above, annulus pressure is stepped down to a desired annulus pressure slowly or in increments. For example, instead of lowering annulus pressure from the predetermined elevated pressure to its original pressure in a rapid one step process, the annulus pressure can be lower at a predetermined rate such as in a plurality of stages, wherein the annulus pressure is lower incrementally in each stage. In this scenario, as the annulus pressure is reduced, there is a reduction in the pressure in operating fluid chamber 176, fluid passageway 188, fluid passageway 190 and on the top side of check valve assembly 150. Fluid does not travel upwardly through check valve assembly 150, however, as check valve 158 prevents such upward flow. The charged biasing fluid in biasing fluid chamber 184 acts on the lower surface of floating piston 186 which pressurizes the operating fluid above floating piston 186 in fluid passageway 196, fluid passageway 194, fluid passageway 192 and the annular region between upper intermediate housing member 112 and valve operating member 148. The pressurized operating fluid acts on the lower surfaces of check valve assembly 150 of piston assembly 146. The fluid pressure generates an upward force on check valve assembly 150 which is transmitted through piston assembly 146 to annular groove 168 of snap sleeve 152 and detents 166 of collet fingers 164.

In this case, however, the upward force of annular groove 168 is insufficient to cause radial outward expansion of collet fingers 164 and snap sleeve 152 does not translate upwardly relative to collet assembly 156. The pressure differential between biasing fluid chamber 184 and operating fluid chamber 176 is equalized over time due to the operation of metering section 200, which allows fluid flow therethrough at a predetermined rate. After a time delay period, for example 10 or 20 minutes, when substantial equalization has occurred, the next stage of the annulus pressure reduction may occur. At the end of the rate controlled annulus pressure reduction, downhole tester valve 100 remains in the open position without keeping annulus pressure at the elevated level. It is noted that at any time during the staged annulus pressure reduction process or thereafter, if it is desired to close downhole tester valve 100, annulus pressure is simply increased to a sufficient level to charge the biasing fluid in biasing fluid chamber 184 in the manner discussed above, wherein annulus pressure is used to pressurize the operation fluid in operation fluid chamber 176 which is communicated through the operating fluid network via fluid passageways 188, 190 and 162, the annular region between upper intermediate housing member 112 and valve operating member 148, and fluid passageways 192, 194 and 196 to the top side of floating piston 186. The annulus pressure is then reduced such that the charged biasing fluid in biasing fluid chamber 184 acts as the energy source for operating valve assembly 126 to the closed position as described above.

Figure 3E:
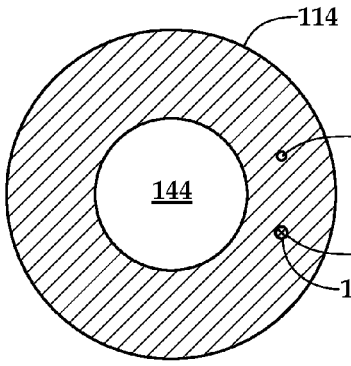
Figure 3D:
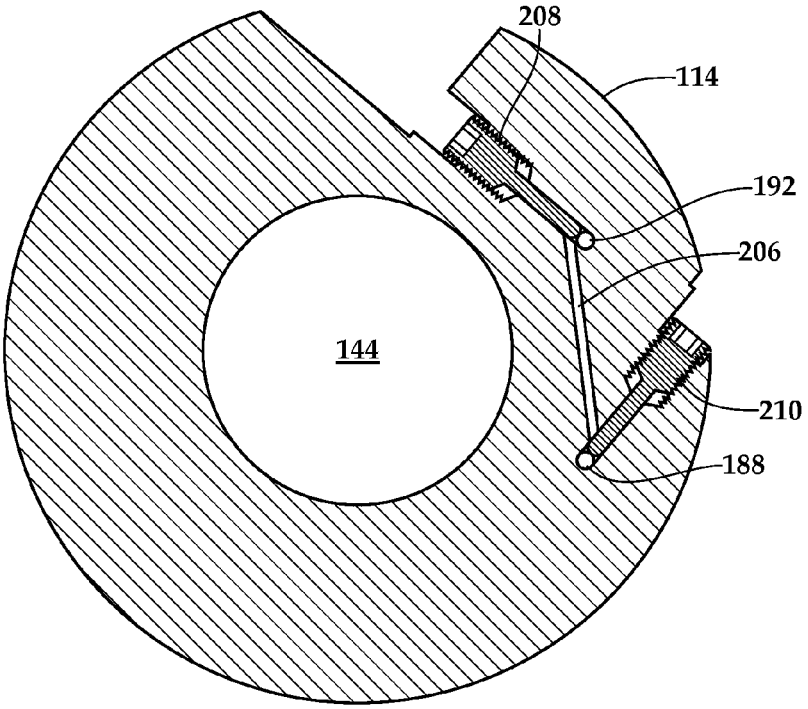

In additional operating mode, it may be desirable to run downhole tester valve 100 into the well in the open position. In this case, pressure is applied to port 182 at the surface to pressurize operating fluid in operating fluid chamber 176 as described above, in such a manner as to shift piston assembly 146 downwardly, which opens valve assembly 126 and actuates check valve 160 to enable rapid charging of biasing fluid in biasing fluid chamber 184. Thereafter, communication can be established between fluid passageway 192 and fluid passageway 188 via a bypass fluid passageway 206 in intermediate housing connector 114, as best seen in FIG. 3D. This can be accomplished by partially retracting plugs 208, 210 to allow fluid communication thereby. This allows for equalization of the pressure in operating fluid chamber 176 and biasing fluid chamber 184. The pressure to port 182 may be released after communication is allowed between fluid passageway 192 and fluid passageway 188 via bypass fluid passageway 206. Thereafter, plugs 208, 210 are repositioned to isolate fluid passageway 192 from fluid passageway 188 and downhole tester valve 100 may be run into the well in the open position. When it is desired to close downhole tester valve 100, annulus pressure is applied, as described above, to charge the biasing fluid in biasing fluid chamber 184 then annulus pressure is reduced such that the charged biasing fluid in biasing fluid chamber 184 acts as the energy source for operating valve assembly 126 to the closed position.

In a further operating mode, it may be desirable to prevent operation of downhole tester valve 100 during certain annulus pressure variations. For example, if other annulus pressure operated tools are going to be actuated prior to operation of downhole tester valve 100, a rupture disk 210 (as seen in FIG. 3E) may be positioned in fluid passageway 188 to prevent the communication of pressure from operation fluid chamber 176 to piston assembly 146. Other pressure operated tools may then be operated, so long as the annulus pressure remains below the burst pressure of rupture disk 210. When it is desired to operate downhole tester valve 100, annulus pressure can be increased above the burst pressure of rupture disk 210. Thereafter, downhole tester valve 100 will operate as described above.

Figure 3F:
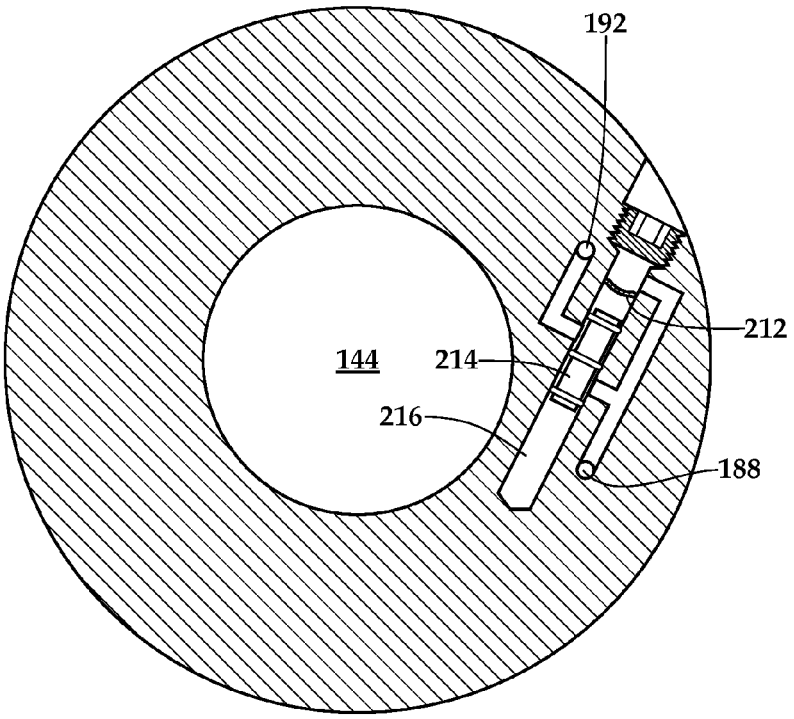

In yet another operating mode, it may be desirable to disable operation of downhole tester valve 100. For example, once the tests performed with downhole tester valve 100 have been completed, it may be desired to permanently leave downhole tester valve in the open or closed position. In either case, as best seen in FIG. 3F, a rupture disk 212 and a shuttle valve 214 may be installed in a bypass passageway 216 between fluid passageway 192 and fluid passageway 188. In the illustrated embodiment, pressure from fluid passageway 188, which is in communication with operating fluid chamber 176 and therefore the annulus pressure, is routed to one side of rupture disk 212. The other side of rupture disk 212 defines an air chamber at low pressure. In this case, once testing operations have been completed, increasing the annulus pressure above the burst pressure of rupture disk 212 will burst rupture disk 212 causing shuttle valve 214 to shift and open bypass passageway 216 between fluid passageway 192 and fluid passageway 188. In this configuration, downhole tester valve 100 is disabled as operating fluid chamber 176 and biasing fluid chamber 184 are permanently equalized as pressure is routed around metering assembly 200. It is noted that in order to disable downhole tester valve 100 in the closed position, annulus pressure must be raised at a predetermined rate such as a slow rate or incrementally as described above to enable the pressure differential between biasing fluid chamber 184 and operating fluid chamber 176 is equalized over time due to the operation of metering section 200, which allows fluid flow therethrough at a predetermined rate. In this manner, the annulus pressure can be raised above the burst pressure of rupture disk 212 without operating downhole tester valve 100 from the closed position to the open position.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method of operating a downhole tester valve comprising:

positioning the downhole tester valve at a location in a wellbore, the downhole tester valve having an operating fluid chamber, a biasing fluid chamber and a power fluid chamber;

applying increased annulus pressure to the power fluid chamber to pressurize operating fluid in the operating fluid chamber;

applying the pressurized operating fluid on a piston assembly of the downhole tester valve to shift a valve assembly of the downhole tester valve from a closed position to an open position;

responsive to predetermined travel of the piston assembly, opening a bypass passageway for the pressurized operating fluid to charge biasing fluid in the biasing fluid chamber;

equalizing pressure in the biasing fluid chamber and the operating fluid chamber by passing operating fluid through a metering section of the downhole tester valve at a first predetermined rate; and reducing annulus pressure at a second predetermined rate based on the first predetermined rate to retain the valve assembly in the open position without the continued application of the increased annulus pressure.

2. The method as recited in claim 1 wherein reducing annulus pressure at the second predetermined rate further comprises reducing annulus pressure in stages.

3. The method as recited in claim 1 further comprising reducing annulus pressure at a third predetermined rate greater than the second predetermined rate to prevent substantially equalizing pressure in the biasing fluid chamber and the operating fluid chamber through the metering section of the downhole tester valve to thereby shift the valve assembly from the open position to the closed position.

4. A downhole tester valve comprising:

a housing assembly;

a mandrel assembly disposed within the housing assembly defining therebetween an operating fluid chamber, a biasing fluid chamber and a power fluid chamber;

a valve assembly disposed within the housing assembly operable between open and closed positions;

a piston assembly operably associated with the valve assembly; and a metering section positioned in a fluid flow path between the biasing fluid chamber and the operating fluid chamber for passing fluid between the biasing fluid chamber and the operating fluid chamber at a first predetermined rate;

wherein, an increase in annulus pressure entering the power fluid chamber pressurizes operating fluid in the operating fluid chamber which acts on the piston assembly to shift the valve assembly from the closed position to the open position;

wherein, predetermined travel of the piston assembly opens a bypass passageway for the pressurized operating fluid to charge biasing fluid in the biasing fluid chamber;

wherein, a reduction in annulus pressure at a second predetermined rate retains the valve assembly in the open position without the continued application of the increased annulus pressure by substantially equalizing pressure in the biasing fluid chamber and the operating fluid chamber by passing operating fluid through the metering section and wherein, a reduction in annulus pressure at a third predetermined rate shifts the valve assembly from the open position to the closed position.

5. The downhole tester valve as recited in claim 4 wherein the piston assembly further comprises a collet assembly and a snap sleeve having first and second positions relative to the collet assembly.

6. The downhole tester valve as recited in claim 5 wherein a first portion of the piston assembly is shiftable relative to a second portion of the piston assembly such that the collet assembly releases the snap sleeve prior to the piston assembly shifting the valve assembly from the closed position to the open position.

7. The downhole tester valve as recited in claim 4 wherein the piston assembly further comprises a check valve assembly having opposing check valves.

8. The downhole tester valve as recited in claim 7 wherein the check valve assembly further comprises end of travel opposing check valves.

9. A method of operating a downhole tester valve comprising:

positioning the downhole tester valve at a location in a wellbore, the downhole tester valve having an operating fluid chamber, a biasing fluid chamber and a power fluid chamber;

increasing annulus pressure to a level below a predetermined level;

applying the increased annulus pressure to the power fluid chamber to pressurize operating fluid in the operating fluid chamber;

applying the pressurized operating fluid on a piston assembly of the downhole tester valve to shift a valve assembly of the downhole tester valve from a closed position to an open position;

responsive to predetermined travel of the piston assembly, opening a bypass passageway for the pressurized operating fluid to charge biasing fluid in the biasing fluid chamber; and increasing annulus pressure above the predetermined level to disable further operation of the valve assembly.

10. The method as recited in claim 9 wherein increasing annulus pressure above the predetermined level further comprises increasing annulus pressure above a burst pressure of a rupture disk positioned in a fluid flow path between the biasing fluid chamber and the operating fluid chamber.

11. The method as recited in claim 9 further comprising reducing annulus pressure and applying operating fluid pressurized by the charged biasing fluid on the piston assembly to shift the valve assembly from the open position to the closed position prior to increasing annulus pressure above the predetermined level.

12. The method as recited in claim 11 further comprising increasing annulus pressure above the predetermined level at a predetermined rate.

13. The method as recited in claim 12 wherein increasing annulus pressure above the predetermined level at the predetermined rate further comprises increasing annulus pressure in stages.

14. The method as recited in claim 12 wherein increasing annulus pressure above the predetermined level at the predetermined rate further comprises substantially equalizing pressure in the biasing fluid chamber and the operating fluid chamber by passing operating fluid through a metering section of the downhole tester valve.

15. The method of claim 9, wherein increasing annulus pressure above the predetermined level to disable further operation of the valve assembly comprises equalizing pressure between the biasing fluid chamber and the operating fluid chamber.

16. A downhole tester valve comprising:

a housing assembly;

a mandrel assembly disposed within the housing assembly defining therebetween an operating fluid chamber, a biasing fluid chamber and a power fluid chamber;

a valve assembly disposed within the housing assembly operable between open and closed positions;

a piston assembly operably associated with the valve assembly; and a rupture disk positioned in a fluid flow path between the biasing fluid chamber and the operating fluid chamber that is operable to burst at a predetermined annulus pressure;

wherein, an increase in annulus pressure to a level below the predetermined annulus pressure entering the power fluid chamber pressurizes operating fluid in the operating fluid chamber which acts on the piston assembly to shift the valve assembly from the closed position to the open position;

wherein, predetermined travel of the piston assembly opens a bypass passageway for the pressurized operating fluid to charge biasing fluid in the biasing fluid chamber; and wherein, a further increase in annulus pressure above the predetermined annulus pressure disables further operation of the valve assembly by bursting the rupture disk.

17. The downhole tester valve as recited in claim 16 wherein the piston assembly further comprises a collet assembly and a snap sleeve having first and second positions relative to the collet assembly.

18. The downhole tester valve as recited in claim 17 wherein a first portion of the piston assembly is shiftable relative to a second portion of the piston assembly such that the collet assembly releases the snap sleeve prior to the piston assembly shifting the valve assembly from the closed position to the open position.

19. The downhole tester valve as recited in claim 16 wherein the piston assembly further comprises a check valve assembly having opposing check valves.

20. The downhole tester valve as recited in claim 19 wherein the check valve assembly further comprises end of travel opposing check valves.

* * * * *